US005520843A

United States Patent [19]

Wright

[11] Patent Number: 5,520,843

[45] Date of Patent: May 28, 1996

[54] VINYL SURFACE CLEANSER AND PROTECTANT

[75] Inventor: Robert C. Wright, Olympia, Wash.

[73] Assignee: Triple R Enterprises, LLC, Olympia, Wash.

[21] Appl. No.: 221,808

[22] Filed: Apr. 1, 1994

[51] Int. Cl.[6] ..... A45B 25/08; C11D 3/37

[52] U.S. Cl. ..... 252/174.24; 252/857; 252/541; 252/173; 252/174.21; 252/174.23; 252/DIG. 2; 134/42

[58] Field of Search ..... 252/8.57, 173, 252/174.21, 174.23, 174.24, DIG. 2, 541; 134/42

[56] References Cited

U.S. PATENT DOCUMENTS

| | | | |
|---|---|---|---|
| 3,294,726 | 12/1966 | Wyner | 252/174.23 |
| 4,028,261 | 6/1977 | Petersen et al. | 252/174.23 |
| 4,065,596 | 12/1977 | Groody | 428/215 |
| 4,071,645 | 1/1978 | Kahn | 427/340 |
| 4,203,859 | 5/1980 | Kirn et al. | 252/174.23 |
| 4,238,244 | 12/1980 | Banks | 134/22 R |
| 4,347,278 | 8/1982 | Flautt et al. | 428/288 |
| 4,481,126 | 11/1984 | Trinh et al. | 252/174.23 |
| 4,759,955 | 7/1988 | Hsu et al. | 427/140 |
| 4,917,823 | 4/1990 | Maile, Jr. | 252/174.23 |

*Primary Examiner*—Margaret Einsmann
*Assistant Examiner*—Caroline L. Dusheck
*Attorney, Agent, or Firm*—Brian J. Coyne

[57] ABSTRACT

A method and composition for cleaning and protecting vinyl, rubber and leather surfaces. The composition comprises a water-based emulsion of acrylic copolymer of RHOPLEX® HA-12, manufactured by Rohm and Haas of Philadelpha, Pa., polyethoxylated alkylphenol, and ammonium hydroxide. The ammonium hydroxide prevents coagulation that otherwise can result from freezing and thawing the composition. Application of the composition to aged and faded vinyl, rubber and leather surfaces cleans and restores the original luster and color without leaving an oily or glossy film.

4 Claims, No Drawings

VINYL SURFACE CLEANSER AND PROTECTANT

BACKGROUND OF THE INVENTION

1. Field of the Invention

This invention relates generally to the field of protectant compositions for use on vinyl, leather and rubber surfaces, especially in automobiles, as well as to the field of compositions for cleaning the same. In particular, this invention relates to vinyl protectant formulations that reduce the oily appearance and feel commonly experienced with the use of such products, and to protectants that incorporate a nonionic surfactant, such as trimethyl-nonylphenyl poly(ethylene oxide).

2. Description of the Prior Art

Because of their durability, light weight and relatively low cost, vinyl polychloride polymer and a variety of plastic materials are commonly incorporated into components of motor vehicle interiors, such as dashboards, door linings, steering wheels and gear shift levers. Unless they are preserved by a suitable film of protectant, the surfaces of such components oxidatively degrade over time, particularly if they are routinely exposed to sunlight, resulting in loss of their original luster and gradual fading of their colors. It is highly desirable that such protectants not leave an oily appearance or feel, particularly as to those components that are frequently manipulated by a driver, such as steering wheels and shift levers. It is also important that protectants applied to automotive interiors not produce so much gloss as to interfere with a driver's vision. Protectants in the prior art within the field of this invention include the following:

U.S. Pat. No. 5,227,200 to LeGrow disclosed a method for protecting automotive vinyl, rubber and leather surfaces by applying to the surfaces a protectant composition that includes an alkylaryl polysiloxane copolymer having long chain hydrocarbon units and aromatic units. In one form of the composition, the alkylaryl polysiloxane was emulsified in water with the aid of a nonionic surfactant, such as trimethylnonylphenyl poly(ethylene oxide). In a solvent solution form of the composition, the alkylaryl silicone was dissolved in a volatile carrier, preferably heptane. In a third form of the composition, an alkylaryl polysiloxane fluid was used without any additives. Advantages claimed for the composition included enhanced affinity for organic surfaces such as rubber and vinyl, greater substantivity and ultraviolet protection, and increased ability to repel water and to be easily flushed clean with water.

U.S. Pat. No. 5,217,758 to Greenleaf et al. disclosed a method for providing a protective finish to a vinyl substrate by the application of a composition comprising a film forming polysiloxane, a diluent, and a wax in the form of micronized particles. Suitable diluents disclosed included water, toluene, mineral spirits and isopropanol. In an alternative embodiment, the composition included an amorphous silica in the form of fumed silica particles. Advantages claimed for both forms of the composition included gloss reduction and decrease in the oiliness of the formulation.

U.S. Pat. No. 4,759,955 to Hsu et al. disclosed a method for restoring, protecting and enhancing polymeric substrates, and in particular vinyl coverings, by applying a composition comprising an acrylic polymer, benzotriazole, and a solvent therefor. The preferred acrylic polymer disclosed was the methylmethacrylate polymer sold under the "Acryloid"® trademark, product designation B44 and B48N by the Rohm & Haas Company of Philadelphia, Pa. Benzotriazole was included in the composition to serve as an adhesion promoter. Advantages reported for use of the composition as applied to vinyl surfaces included the ability to restore and enhance the appearance of vinyl surfaces coated by polymers such as vinyl fabrics, restoration of original color of aged vinyl surfaces, and an excellent resistance to ultraviolet light and yellowing with age.

Rohm and Haas of Philadelphia, Pa., has manufactured and sold an acrylic copolymer emulsion under the trademark RHOPLEX® HA-12, which has been known to form firm, tack-free films suitable for fabric finishings, backcoating, and other applications where abrasion resistance was required. Use of this acrylic copolymer in a vinyl surface protectant has suffered, however, from the disadvantage that it coagulates if stored at ambient temperatures below the freezing point of water, rendering it thereafter unsuitable for use as a protectant.

Although acrylic polymers, including RHOPLEX® HA-12 used in the present invention, are known in the art, their use in is believed to be new in a composition that simultaneously eliminates the coagulation problem due to freezing, provides a non-oily appearance and feel, avoids excessive gloss, and provides surface cleansing during application.

SUMMARY OF THE INVENTION

It is an object of the present invention to provide an improved acrylic copolymer containing automotive vinyl, rubber and leather protectant in the form of a water-based emulsion.

It is an object of the present invention to provide a protectant composition that does not coagulate if frozen and thawed.

It is an object of the present invention to provide a protectant composition that contains a cleansing agent such that application of the protectant to a vinyl, rubber or leather surface simultaneously cleans the surface and leaves a protective film on the surface.

It is an object of the present invention to provide a protectant composition that restores the original luster and color when applied to aged vinyl surfaces.

It is an object of the present invention to provide a protectant composition that is antistatic, and does not produce excessive gloss, when applied to vinyl, rubber and leather surfaces.

These and other objects, features and advantages of the present invention will become more apparent from a consideration of the following detailed description thereof.

DETAILED DESCRIPTION OF THE INVENTION

RHOPLEX® HA-12 is a self cross linking acrylic copolymer emulsion composed of 44–46 percent by weight acrylic copolymer, water 54–56 percent by weight, 0.05 percent by weight formaldehyde, and trace amounts of individual residual monomers. It is a milky white fluid having pH 2.1 to 4.0, viscosity 100 to 750 centipoise, specific gravity 1.0 to 1.2 relative to water, and it is dilutable in water. The chemical structure of the acrylic copolymer in RHOPLEX® HA-12 emulsion is a trade secret of Rohm and Haas, Inc., of Philadelphia, Pa. The minimum recommended storage temperature for this material is 1C/34F because freezing and thawing it can cause it to coagulate.

In the preferred embodiment, the protectant composition of the present invention is a mixture of 10–17 percent by weight of acrylic copolymer of RHOPLEX® HA-12, 0.5–1.5 percent by weight of polyethoxylated alkylphenol, 0.2–1.0 percent by weight of ammonium hydroxide, and the balance of the composition comprises water. The ammonium hydroxide is necessary in order to prevent coagulation in the event of freezing and thawing of the composition. Too much ammonium hydroxide, however, is counterproductive as it would raise the pH of the composition out of the desired range of 3.5 to 7.0. The composition preferably also includes a foam inhibitor such as polypropylene glycol in sufficient amount to inhibit foam formation, for example, PLURONIC® 61, manufactured by BASF Corporation of Parsippany, N.J.

The polyethoxylated alkylphenol is a nonionic surfactant that facilitates removal of dirt as the composition is being applied to a surface, for example by rubbing with a soft cloth. A suitable source of polyethoxylated alkylphenol is IGEPAL® CO 730 GAF, or alternatively, ANTAROX® L61, manufactured by Rhone-Poulenc of Cranbury, N.J.

The following examples are set forth for the purpose of further illustrating the concepts of the invention.

EXAMPLE 1

A 12 gallon batch of the protectant composition was prepared in a well ventilated facility by the following steps:

diluting 1.2 lbs. IGEPAL® CO 730 GAF in 7.98 gallons of water;

blending into the diluted IGEPAL® 3.66 gallons of RHOPLEX® HA-12 emulsion;

adding PLURONIC® 61 to eliminate any foam;

adding four ounces of an aqueous solution of ammonium hydroxide (29.4 percent by weight); and filling plastic containers with the resulting emulsions by tube from the bottom in order to avoid introducing air bubbles. Freezing and thawing the resulting composition did not cause coagulation.

The resulting protectant composition was applied by rubbing with a soft cloth to a soiled and faded, blue vinyl-coated fabric obtained from the interior of a 1979 Datsun automobile. The original blue color and luster were restored to the fabric and a non-glossy, non-oily finish was obtained. Touching the finish with the fingers left no evident fingerprints.

EXAMPLE 2

The composition of example 1 was applied by soft cloth to the steering wheel of a 1986 Honda Accord automobile. After the composition had dried, it was observed that the steering wheel had a matte finish that was not oily or slippery.

EXAMPLE 3

The composition of Example 1 was applied to the dashboard of a 1994 Mitsubishi Expo LRV mini-minivan. There was no noticeable increase in light glare in the windshield area from sunlight reflected from the dashboard.

The present invention has been disclosed in connection with preferred embodiments thereof; one of ordinary skill will be able to effect various alterations, substitutions or equivalents and other changes without departing from the spirit and scope of the invention as disclosed. It is therefore intended that the scope of Letters Patent granted hereon be limited only to the definition contained in the appended claims and equivalents thereof.

The embodiments of the invention in which an exclusive property or privilege is claimed are defined as follows:

I claim:

1. A cleanser and protectant composition for vinyl, plastic, leather, and rubber surfaces that is stable to freezing and thawing, consisting essentially of 10–17 percent by weight of a self cross-linking acrylic copolymer emulsion composed of 44–46 percent by weight acrylic copolymer, 54–56 percent by weight water, 0.05 percent by weight formaldehyde, and trace amounts of individual residual monomers, said emulsion being a milky white fluid having a pH of 2.1 to 4.0, viscosity of 100 to 750 centipoise, specific gravity of 1.0 to 1.2 relative to water, and which is dilutable with water; 0.5–1.0 percent by weight of polyethoxylated alkylphenol; 0.2–1.0 percent by weight of ammonium hydroxide; and the balance of the composition comprises water.

2. The cleanser and protectant composition of claim 1 further consisting essentially of a foam inhibitor in an amount sufficient to substantially eliminate all foam from the composition.

3. The cleanser and protectant composition of claim 2 wherein the foam inhibitor consists essentially of propylene glycol.

4. A method of cleaning and providing a protective finish to a vinyl, plastic, rubber or leather surface, comprising applying to the surface the cleanser and protectant composition of claim 2 with a soft cloth, wiping away dirt and excess composition, and permitting to dry.

* * * * *